US011913694B2

(12) United States Patent
Hayashida et al.

(10) Patent No.: US 11,913,694 B2
(45) Date of Patent: Feb. 27, 2024

(54) HEAT PUMP SYSTEM

(71) Applicant: Mitsubishi Electric Corporation, Tokyo (JP)

(72) Inventors: Kazuki Hayashida, Tokyo (JP); Yasushi Okoshi, Tokyo (JP); Takuya Ito, Tokyo (JP); Yoshio Yamano, Tokyo (JP); Kimitaka Kadowaki, Tokyo (JP); Takahiro Akizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 881 days.

(21) Appl. No.: 16/966,090

(22) PCT Filed: Mar. 7, 2018

(86) PCT No.: PCT/JP2018/008716
§ 371 (c)(1),
(2) Date: Jul. 30, 2020

(87) PCT Pub. No.: WO2019/171485
PCT Pub. Date: Sep. 12, 2019

(65) Prior Publication Data

US 2021/0033324 A1 Feb. 4, 2021

(51) Int. Cl.
*F25B 47/02* (2006.01)
*F24F 11/74* (2018.01)
(Continued)

(52) U.S. Cl.
CPC ..... *F25B 47/02* (2013.01); *F24F 11/42* (2018.01); *F24F 11/74* (2018.01); *F25B 13/00* (2013.01);
(Continued)

(58) Field of Classification Search
CPC ..... G05B 15/02; F24F 11/74; F24F 11/42; F25B 13/00; F25B 49/02
(Continued)

(56) References Cited

U.S. PATENT DOCUMENTS 5,109,677 A * 5/1992 Phillippe ..... F25B 13/00 62/160
10,101,059 B2 * 10/2018 Ma ..... F25B 15/02
(Continued)

FOREIGN PATENT DOCUMENTS

CN 105135504 A * 12/2015
EP 2 784 414 A1 10/2014
(Continued)

OTHER PUBLICATIONS

International Search Report of the International Searching Authority dated Jun. 5, 2018 for the corresponding international application No. PCT/JP2018/008716 (and English translation).

*Primary Examiner* — Ronald D Hartman, Jr.
(74) *Attorney, Agent, or Firm* — POSZ LAW GROUP, PLC

(57) ABSTRACT

A heat pump system includes a refrigerant circuit in which a compressor, a refrigerant flow path included in a heat medium heat exchanger, an expansion valve, and a heat source side heat exchanger are connected, the heat medium heat exchanger including the refrigerant flow path and a heat medium flow path; a heat medium feed path connected to the heat medium flow path included in the heat medium heat exchanger; an indoor unit connected to the heat medium feed path and configured to condition air inside a room; a room temperature sensor configured to detect an indoor temperature in the room; a heat medium temperature sensor configured to detect a temperature of a heat medium that flows into the indoor unit; and a controller configured to
(Continued)

control the refrigerant circuit or the indoor unit by using a set temperature in the room.

16 Claims, 6 Drawing Sheets

(51) Int. Cl.
*F24F 11/42* (2018.01)
*F25B 13/00* (2006.01)
*F25B 49/02* (2006.01)
*F24F 110/10* (2018.01)

(52) U.S. Cl.
CPC ..... *F25B 49/02* (2013.01); *F24F 2110/10* (2018.01); *F25B 2700/11* (2013.01); *F25B 2700/2103* (2013.01); *F25B 2700/2104* (2013.01)

(58) Field of Classification Search
USPC ..... 700/276
See application file for complete search history.

(56) References Cited

U.S. PATENT DOCUMENTS

| | | | | |
|---|---|---|---|---|
| 11,635,226 | B1 * | 4/2023 | Puga | F24F 11/81 165/58 |
| 2011/0218683 | A1 * | 9/2011 | Ben-Yaacov | F24D 11/0228 700/278 |
| 2012/0000237 | A1 * | 1/2012 | Yamada | F25B 1/10 62/324.6 |
| 2014/0048244 | A1 * | 2/2014 | Wallace | F24H 15/421 165/253 |
| 2018/0120011 | A1 * | 5/2018 | Goldman | F25B 13/00 |
| 2019/0030992 | A1 * | 1/2019 | Tada | B60H 1/22 |
| 2021/0262708 | A1 * | 8/2021 | Ryu | F25B 30/02 |

FOREIGN PATENT DOCUMENTS

| | | | |
|---|---|---|---|
| JP | 2009-109060 | A | 5/2009 |
| JP | 2011-058659 | A | 3/2011 |
| JP | 2011-064438 | A | 3/2011 |
| WO | 2013/077167 | A1 | 5/2013 |

* cited by examiner

FIG. 5

| TIME | t1 | t2 | t3 | t4 | t5 | t6 |
|---|---|---|---|---|---|---|
| HEAT PUMP SYSTEM 100 | ROOM HEATING MODE | DEFROSTING PREPARATION DETECTION OF FIRST HEAT PUMP DEVICE 1a | HEAT STORAGE MODE | DEFROSTING STARTING DETECTION OF FIRST HEAT PUMP DEVICE 1a | DEFROSTING MODE | ROOM HEATING MODE |
| FIRST HEAT PUMP DEVICE 1a | HEATING OPERATION AT THE TIME OF ROOM HEATING MODE Tm = Tu | FROST FORMATION AMOUNT > FIRST FROST FORMATION AMOUNT A | HEATING OPERATION AT THE TIME OF HEAT STORAGE MODE Tm = Tu + $\alpha$ | FROST FORMATION AMOUNT > SECOND FROST FORMATION AMOUNT B | DEFROSTING OPERATION AT THE TIME OF DEFROSTING MODE Tm = Tu − $\beta$ | HEATING OPERATION AT THE TIME OF ROOM HEATING MODE Tm = Tu |
| SECOND HEAT PUMP DEVICE 1b | HEATING OPERATION AT THE TIME OF ROOM HEATING MODE Tm = Tu | FROST FORMATION AMOUNT ≤ FIRST FROST FORMATION AMOUNT A | HEATING OPERATION AT THE TIME OF HEAT STORAGE MODE Tm = Tu + $\alpha$ | FROST FORMATION AMOUNT ≤ FIRST FROST FORMATION AMOUNT A | HEATING OPERATION AT THE TIME OF DEFROSTING MODE Tm = Tu + $\alpha$ | HEATING OPERATION AT THE TIME OF ROOM HEATING MODE Tm = Tu |
| THIRD HEAT PUMP DEVICE 1c | HEATING OPERATION AT THE TIME OF ROOM HEATING MODE Tm = Tu | FROST FORMATION AMOUNT ≤ FIRST FROST FORMATION AMOUNT A | HEATING OPERATION AT THE TIME OF HEAT STORAGE MODE Tm = Tu + $\alpha$ | FROST FORMATION AMOUNT ≤ FIRST FROST FORMATION AMOUNT A | HEATING OPERATION AT THE TIME OF DEFROSTING MODE Tm = Tu + $\alpha$ | HEATING OPERATION AT THE TIME OF ROOM HEATING MODE Tm = Tu |
| FOURTH HEAT PUMP DEVICE 1d | HEATING OPERATION AT THE TIME OF ROOM HEATING MODE Tm = Tu | FROST FORMATION AMOUNT ≤ FIRST FROST FORMATION AMOUNT A | HEATING OPERATION AT THE TIME OF HEAT STORAGE MODE Tm = Tu + $\alpha$ | FROST FORMATION AMOUNT ≤ FIRST FROST FORMATION AMOUNT A | HEATING OPERATION AT THE TIME OF DEFROSTING MODE Tm = Tu + $\alpha$ | HEATING OPERATION AT THE TIME OF ROOM HEATING MODE Tm = Tu |

HEAT PUMP SYSTEM

CROSS REFERENCE TO RELATED APPLICATION

This application is a U.S. national stage application of PCT/JP2018/008716 filed on Mar. 7, 2018, the contents of which are incorporated herein by reference.

TECHNICAL FIELD

The present disclosure relates to a heat pump system including a refrigerant circuit, a heat medium feed path, and an indoor unit.

BACKGROUND ART

Some heat pump system including a refrigerant circuit, a heat medium feed path, and an indoor unit has been known (for example, see Patent Literature 1). The heat pump system of Patent Literature 1 prevents a decrease of a water temperature by avoiding a situation as much as possible where two or more heat pumps perform a defrosting operation around the same time.

CITATION LIST

Patent Literature

Patent Literature 1: International Publication No. WO 2013/077167

SUMMARY OF INVENTION

Technical Problem

However, in the heat pump system of Patent Literature 1, as the heat pumps that perform the defrosting operation decrease the water temperature, an indoor comfortability may deteriorate because of the decrease of the water temperature.

The present disclosure has been made in view of the aforementioned problem, and it is an object to obtain a heat pump system that improves an indoor comfortability.

Solution to Problem

A heat pump system according to an embodiment of the present disclosure includes a refrigerant circuit in which a compressor, a refrigerant flow path included in a heat medium heat exchanger, an expansion valve, and a heat source side heat exchanger are connected, the heat medium heat exchanger including the refrigerant flow path and a heat medium flow path; a heat medium feed path connected to the heat medium flow path included in the heat medium heat exchanger; an indoor unit connected to the heat medium feed path and configured to condition air inside a room; a room temperature sensor configured to detect an indoor temperature in the room; a heat medium temperature sensor configured to detect a temperature of a heat medium that flows into the indoor unit; and a controller configured to control the refrigerant circuit or the indoor unit by using a set temperature in the room, the indoor temperature detected by the room temperature sensor, and the temperature detected by the heat medium temperature sensor in such a manner that the indoor temperature detected by the room temperature sensor is not deviated from the set temperature.

Advantageous Effects of Invention

With the heat pump system according to an embodiment of the present disclosure, as the refrigerant circuit or the indoor unit is controlled in such a manner that the indoor temperature detected by the room temperature sensor is not deviated from the set temperature, the indoor comfortability is improved.

BRIEF DESCRIPTION OF DRAWINGS

FIG. 5 is a diagram illustrating one example of an operation of the heat pump system illustrated in FIG. 1.

DESCRIPTION OF EMBODIMENTS

Figure 1:
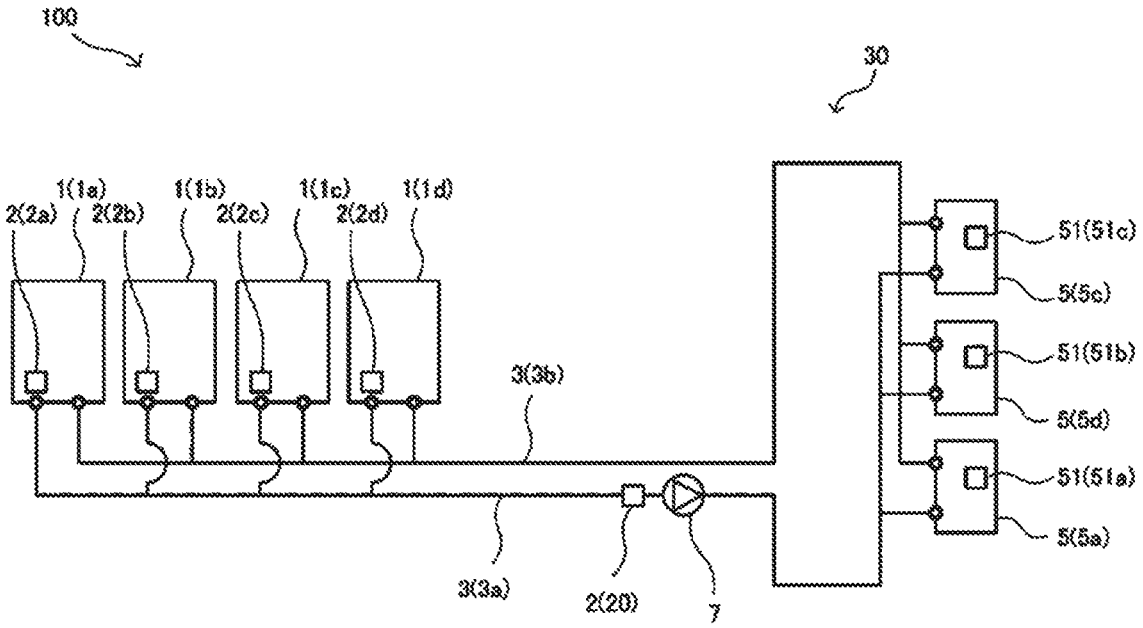
FIG. 1 is a diagram illustrating one example of a heat pump system according to Embodiment 1 of the present disclosure.

Embodiments of the present disclosure will be described hereinafter with reference to the drawings. It is noted that the same or equivalent parts in the drawings are assigned with the same reference signs, and descriptions of the parts will be appropriately omitted or simplified. In addition, with regard to components illustrated in the drawings, shapes, sizes, arrangements, and other aspects of the components can be appropriately changed within the scope of the present disclosure.

Embodiment 1

Heat Pump System

Figure 2:
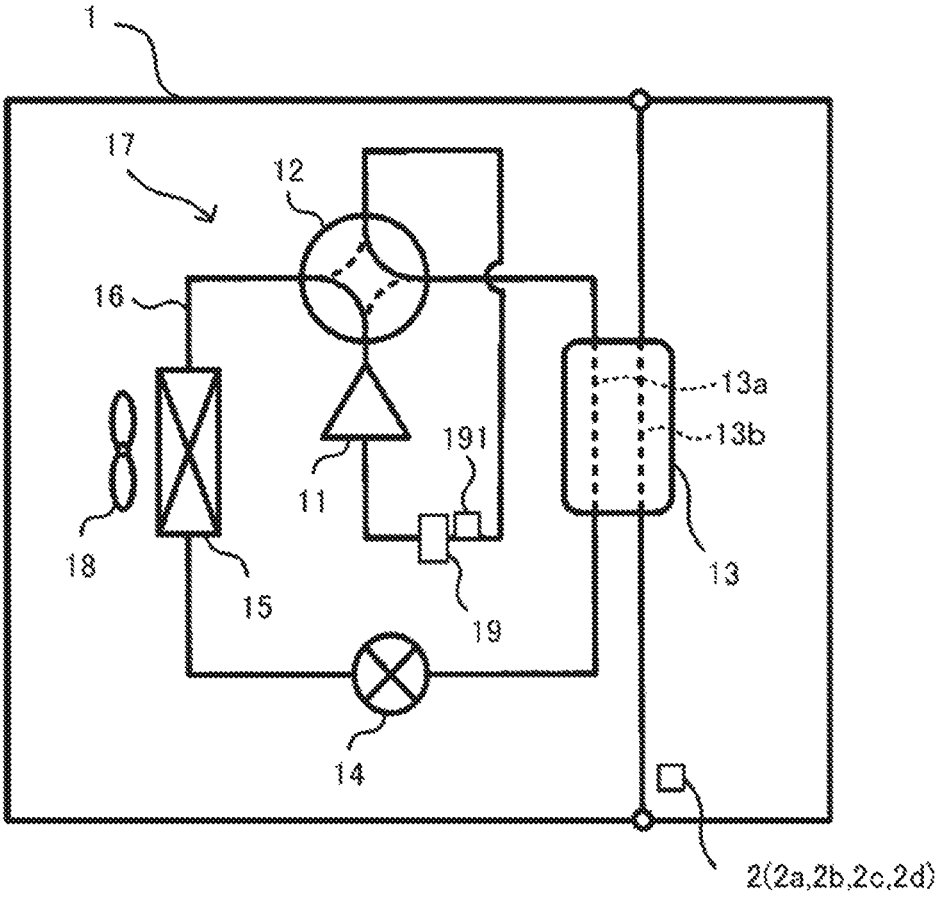
FIG. 2 is a diagram illustrating one example of a heat pump device of the heat pump system illustrated in FIG. 1.
Figure 3:
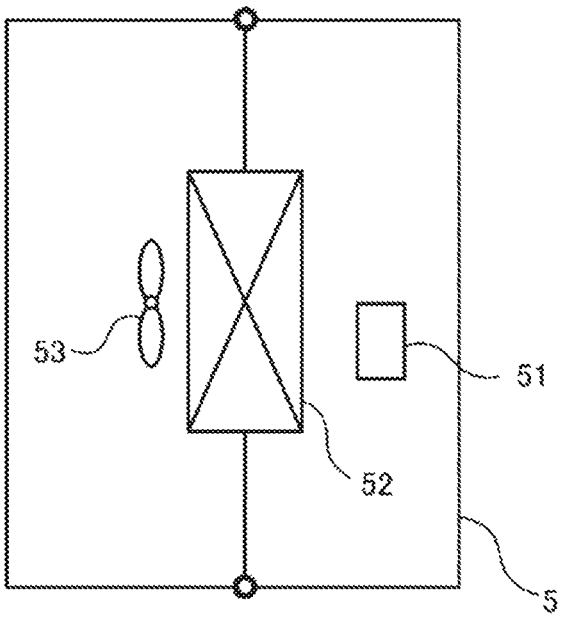
FIG. 3 is a diagram illustrating one example of an indoor unit of the heat pump system illustrated in FIG. 1.

FIG. 1 is a diagram illustrating one example of a heat pump system according to Embodiment 1 of the present disclosure. FIG. 2 is a diagram illustrating one example of a heat pump device of the heat pump system illustrated in FIG. 1. FIG. 3 is a diagram illustrating one example of an indoor unit of the heat pump system illustrated in FIG. 1. A heat pump system 100 illustrated in FIG. 1 is configured, for example, to condition air of an air-conditioned space inside a room in a building or other structure by using a heat medium heated or cooled by a heat pump device 1.

The heat pump system 100 has a heat medium feed path 30 formed by connecting the heat pump devices 1, indoor units 5, and a heat medium feed device 7 by heat medium pipes 3. As shown in FIG. 2, a heat medium flow path 13*b* included in a heat medium heat exchanger 13 of the heat pump device 1 is connected to the heat medium feed path 30. As shown in FIG. 1, the heat medium feed path 30 is, for example, circularly formed in such a manner that the heat medium circulates. The heat medium feed path 30 may also be a path in which at least a part of the heat medium does not circulate. The heat medium that does not circulate in the heat medium feed path 30 is used for hot water supply or other purposes. The heat medium is, for example, water. The heat medium may also be brine, carbon dioxide, or other substances. It is noted that the heat pump system 100 may also be provided, to the heat medium feed path 30, with a tank that stores the heat medium, a heat medium supply device that supplies the heat medium, or other parts.

The heat medium feed device 7 is configured to feed the heat medium, and is, for example, a pump. The heat medium feed device 7 is disposed downstream of all the heat pump devices 1 and upstream of all the indoor units 5 in the heat medium feed path 30. The heat medium feed device 7 may also be disposed downstream of all the indoor units 5 and upstream of all the heat pump devices 1 in the heat medium feed path 30. The heat medium feed device 7 may also be accommodated in the heat pump device 1. The heat pump system 100 of FIG. 1 includes the single heat medium feed device 7, but the heat pump system 100 may also include a plurality of heat medium feed devices such as two or more of the heat medium feed devices 7. The plurality of heat medium feed devices 7 may be connected in series or in parallel.

In addition, the heat pump system 100 includes heat medium temperature sensors 2 each configured to detect a temperature of the heat medium that flows into the indoor units 5, and room temperature sensors 51 each configured to detect an indoor temperature that is an indoor air temperature inside a room.

The heat medium temperature sensor 2 is provided with, for example, a thermistor or other parts attached on a surface of a water pipe or other areas. The heat medium temperature sensor 2 may also be provided with a thermocouple, a resistance temperature detector, or other parts disposed inside the water pipe. The heat medium temperature sensors 2 include, for example, a first outflow temperature sensor 2*a*, a second outflow temperature sensor 2*b*, a third outflow temperature sensor 2*c*, a fourth outflow temperature sensor 2*d*, and a representative temperature sensor 20. It is noted that the heat medium temperature sensors 2 are only required to be configured to detect the temperature of the heat medium that flows into the indoor units 5, and for example, one or more of the first outflow temperature sensor 2*a* to the fourth outflow temperature sensor 2*d* and the representative temperature sensor 20 may also be omitted. For example, when the temperature of the heat medium that flows into the indoor units 5 is estimated by using detection results of the first outflow temperature sensor 2*a* to the fourth outflow temperature sensor 2*d*, the representative temperature sensor 20 can be omitted.

As shown in FIG. 2, the first outflow temperature sensor 2*a* is configured to detect the temperature of the heat medium that has exchanged heat in the heat medium heat exchanger 13 of a first heat pump device 1*a*. The second outflow temperature sensor 2*b* is configured to detect the temperature of the heat medium that has exchanged heat in the heat medium heat exchanger 13 of a second heat pump device 1*b*. The third outflow temperature sensor 2*c* is configured to detect the temperature of the heat medium that has exchanged heat in the heat medium heat exchanger 13 of a third heat pump device 1*c*. The fourth outflow temperature sensor 2*d* is configured to detect the temperature of the heat medium that has exchanged heat in the heat medium heat exchanger 13 of a fourth heat pump device 1*d*. The first outflow temperature sensor 2*a* to the fourth outflow temperature sensor 2*d* are respectively accommodated in the first heat pump device 1*a* to the fourth heat pump device 1*d*. Each of the first outflow temperature sensor 2*a* to the fourth outflow temperature sensor 2*d* may be attached, for example, to the heat medium pipe 3, which is outside the first heat pump device 1*a* to the fourth heat pump device 1*d*.

The representative temperature sensor 20 illustrated in FIG. 1 is configured to detect the temperature of the heat medium after the heat medium passes through all the heat medium heat exchangers 13 of the plurality of heat pump devices 1 and before the heat medium flows into the indoor units 5. The representative temperature sensor 20 is disposed downstream of the plurality of heat pump devices 1 and upstream of the plurality of indoor units 5 in the heat medium feed path 30. The representative temperature sensor 20 is disposed upstream of the heat medium feed device 7 in the heat medium feed path 30, but may also be disposed downstream of the heat medium feed device 7.

The room temperature sensors 51 include a first room temperature sensor 51*a* disposed inside a first indoor unit 5*a*, a second room temperature sensor 51*b* disposed inside a second indoor unit 5*b*, and a third room temperature sensor 51*c* disposed inside a third indoor unit 5*c*. To facilitate the understanding of this embodiment, when the first room temperature sensor 51*a*, the second room temperature sensor 51*b*, and the third room temperature sensor 51*c* do not particularly need to be distinguished from one another, these room temperature sensors are each simply described as the room temperature sensor 51. The room temperature sensors 51 are only required to be configured to detect the indoor temperature in the room. For example, one or more of the first room temperature sensor 51*a* to the third room temperature sensor 51*c* can be omitted. In addition, for example, the room temperature sensors 51 are disposed inside the indoor units 5, but the room temperature sensors 51 may also be disposed outside the indoor units 5 and disposed inside a room. The room temperature sensor 51 is provided with a thermistor or other devices. It is noted that the room temperature sensor 51 can be omitted when the control using the room temperature sensor 51 is not exercised.

Heat Pump Device

The heat pump system 100 includes the first heat pump device 1*a*, the second heat pump device 1*b*, the third heat pump device 1*c*, and the fourth heat pump device 1*d*. To facilitate the understanding of this embodiment, when the first heat pump device 1*a*, the second heat pump device 1*b*, the third heat pump device 1*c*, and the fourth heat pump device 1*d* do not particularly need to be distinguished from one another, these heat pump devices are each simply described as the heat pump device 1.

The heat pump device 1 is an outdoor unit disposed outside the air-conditioned space, for example. The heat pump device 1 is disposed in an outdoor space, a machine room, or other spaces, which are outside a room, and the room defines an air-conditioned space. It is noted that the heat pump system 100 is not limited to a heat pump system that includes the four heat pump devices 1, and a heat pump system that has one or more of the heat pump devices 1 may be used. The plurality of heat pump devices 1 are mutually connected in parallel and connected to the heat medium feed path 30. It is noted that the plurality of heat pump devices 1 may also be connected in series to the heat medium feed path 30.

As shown in FIG. 2, each of the heat pump devices 1 includes a refrigerant circuit 17 formed by circularly connecting a compressor 11, a flow path switch device 12, a refrigerant flow path 13*a* included in the heat medium heat exchanger 13, an expansion valve 14, a heat source side heat exchanger 15, and an accumulator 19 by a refrigerant pipe 16. Refrigerant circulates in the refrigerant circuit 17. The refrigerant used in the refrigerant circuit 17 is not particularly limited, but for example, refrigerant having a low global warming potential (GWP) such as R410A and R32, natural refrigerant such as propane, or mixed refrigerant containing at least one of these refrigerants is used. It is noted that the refrigerant sealed in the refrigerant circuit 17 may also vary in two or more of the plurality of heat pump devices 1. In the example of this embodiment, as the refrigerant circuit 17 is independent in each of the heat pump devices 1, for example, when abnormality occurs in the refrigerant circuit 17 of the single heat pump device 1, the heat pump device 1 where the abnormality occurs is stopped, and the heat pump system 100 can be operated by using the other heat pump devices 1 that normally operate.

The compressor 11 is configured to compress suctioned refrigerant to bring the refrigerant into a high temperature and high pressure state and discharge the refrigerant. The compressor 11 is, for example, an inverter compressor in which control is exercised by an inverter, and a capacity (the amount of refrigerant to be fed per unit time) can be changed by optionally changing an operation frequency. For example, when the temperature of the heat medium approaches a target temperature, the compressor 11 decreases the operation frequency, and operates with a small capacity. It is noted that the compressor 11 may also be a constant speed compressor that operates at a fixed operation frequency.

The flow path switch device 12 is, for example, a four-way valve or other parts, and configured to switch a direction in which the refrigerant flows to a direction in which the refrigerant flows in a heating operation in which the heat medium heat exchanger 13 heats the heat medium and to a direction in which the refrigerant flows in a cooling operation in which the heat medium heat exchanger 13 cools the heat medium. It is noted that in the example of FIG. 2, at the time of the cooling operation, the flow path switch device 12 is switched to a state represented by solid lines, and at the time of the heating operation, the flow path switch device 12 is switched to a state represented by broken lines.

The heat medium heat exchanger 13 exchanges heat between the refrigerant of the refrigerant circuit 17 and the heat medium of the heat medium feed path 30. The heat medium heat exchanger 13 includes the refrigerant flow path 13*a* in which the refrigerant of the refrigerant circuit 17 flows, and the heat medium flow path 13*b* in which the heat medium of the heat medium feed path 30 flows. The heat medium heat exchanger 13 is, for example, a plate type heat exchanger. The expansion valve 14 is configured to expand the refrigerant. The expansion valve 14 is, for example, an electronic expansion valve that can adjust an opening degree, a temperature type expansion valve, or other valves, but may also be a capillary tube in which an opening degree is not adjustable, or other parts.

The heat source side heat exchanger 15 is, for example, an air heat exchanger of a fin tube type that formed by fins and a tube and exchanges heat between the refrigerant and air. The heat source side heat exchanger 15 may also be a plate type heat exchanger that exchanges heat between the refrigerant and a heat medium. A heat source side fan 18 is disposed in the vicinity of the heat source side heat exchanger 15. The heat source side fan 18 is configured to send air to the heat source side heat exchanger 15, and promotes heat exchange between the refrigerant and air. The accumulator 19 is disposed to a suction port of the compressor 11. The accumulator 19 is a container that stores the refrigerant.

A heat exchanger downstream temperature sensor 191 is disposed at an inlet of the accumulator 19. The heat exchanger downstream temperature sensor 191 is configured to detect a temperature of the refrigerant subjected to heat exchange in the heat source side heat exchanger 15. The heat exchanger downstream temperature sensor 191 is only required to be disposed downstream of the heat source side heat exchanger 15 and upstream of the accumulator 19. The heat exchanger downstream temperature sensor 191 is provided with, for example, a thermistor or other parts. The heat exchanger downstream temperature sensor 191 is equivalent to a "frost formation detection sensor" of the present disclosure. Frost formation of the heat source side heat exchanger 15 can be detected by using the temperature detected by the heat exchanger downstream temperature sensor 191. This is because when frost is formed on the heat source side heat exchanger 15, the temperature of the refrigerant does not increase as a heat exchange efficiency of the heat source side heat exchanger 15 decreases. It is noted that the "frost formation detection sensor" is not limited to the heat exchanger downstream temperature sensor 191, and the "frost formation detection sensor" is only required to be configured to detect the frost formation of the heat source side heat exchanger 15.

An operation of the refrigerant circuit 17 in the cooling operation in which the heat medium heat exchanger 13 cools the heat medium will be described. At the time of the cooling operation, the flow path switch device 12 is switched to the state represented by the solid lines. The high temperature and high pressure refrigerant compressed by the compressor 11 transfers heat while the refrigerant is condensed in the heat source side heat exchanger 15. The refrigerant condensed in the heat source side heat exchanger 15 expands in the expansion valve 14. The refrigerant that has expanded in the expansion valve 14 absorbs heat from the heat medium while the refrigerant evaporates in the heat medium heat exchanger 13, and cools the heat medium. The refrigerant that has evaporated in the heat medium heat exchanger 13 is suctioned into the compressor 11 and compressed again.

An operation of the refrigerant circuit 17 in the heating operation in which the heat medium heat exchanger 13 heats the heat medium will be described. At the time of the heating operation, the flow path switch device 12 is switched to the state represented by the broken lines. The high temperature and high pressure refrigerant compressed by the compressor 11 transfers heat to the heat medium while the refrigerant is condensed in the heat medium heat exchanger 13, and heats the heat medium. The refrigerant condensed in the heat medium heat exchanger 13 expands in the expansion valve 14. The refrigerant that has expanded in the expansion valve 14 evaporates in the heat source side heat exchanger 15. The refrigerant that has evaporated in the heat source side heat exchanger 15 is suctioned into the compressor 11 and compressed again.

Indoor Unit

As shown in FIG. 1, the heat pump system 100 includes the first indoor unit 5*a*, the second indoor unit 5*b*, and the third indoor unit 5*c*. To facilitate the understanding of this embodiment, when the first indoor unit 5*a*, the second indoor unit 5*b*, and the third indoor unit 5*c* do not particularly need to be distinguished from one another, these indoor units are each simply described as the indoor unit 5.

The indoor unit 5 is configured to condition air in the air-conditioned space by using heat of the heat medium. The indoor unit 5 is disposed, for example, inside the air-conditioned space. It is noted that the heat pump system 100 is not limited to a system including the three indoor units 5, and the heat pump system 100 may have one or more indoor units 5. The plurality of indoor units 5 are mutually connected in parallel and connected to the heat medium feed path 30. It is noted that the plurality of indoor units 5 may also be connected in series to the heat medium feed path 30. The plurality of indoor units 5 are, for example, configured to condition air in the same room, but two or more of the plurality of indoor units 5 may condition air in different rooms.

As shown in FIG. 3, each of the indoor units 5 includes a use side heat exchanger 52 in which the heat medium flows, and an indoor fan 53 configured to send air to the use side heat exchanger 52. The use side heat exchanger 52 is, for example, a fin tube type heat exchanger formed by fins and a tube. When the indoor fan 53 operates, air-conditioned air that has exchanged heat when the air passes through the use side heat exchanger 52 blows off to the air-conditioned space. It is noted that the indoor unit 5 may also be an indoor unit including a radiant system heat exchanger, a water heater, or other devices. In addition, the indoor unit 5 includes the room temperature sensor 51. The room temperature sensor 51 detects the indoor air temperature after the air is suctioned into the indoor unit 5 and before the air passes through the use side heat exchanger 52 to detect the temperature in the room.

An operation of the heat medium feed path 30 shown in FIG. 1 will be described. When the heat medium feed device 7 operates, the heat medium of the heat medium feed path 30 is fed. The heat media that flow into the heat pump devices 1 exchange heat with the refrigerant in the heat medium heat exchangers 13 of the heat pump devices 1. The heat media that have exchanged heat in the heat medium heat exchangers 13 flow into the indoor units 5, and exchange heat with air in the room in the use side heat exchangers 52 of the indoor units 5. The heat media that have exchanged heat in the use side heat exchangers 52 flow into the heat pump devices 1 again.

Control System of Heat Pump System

Figure 4:
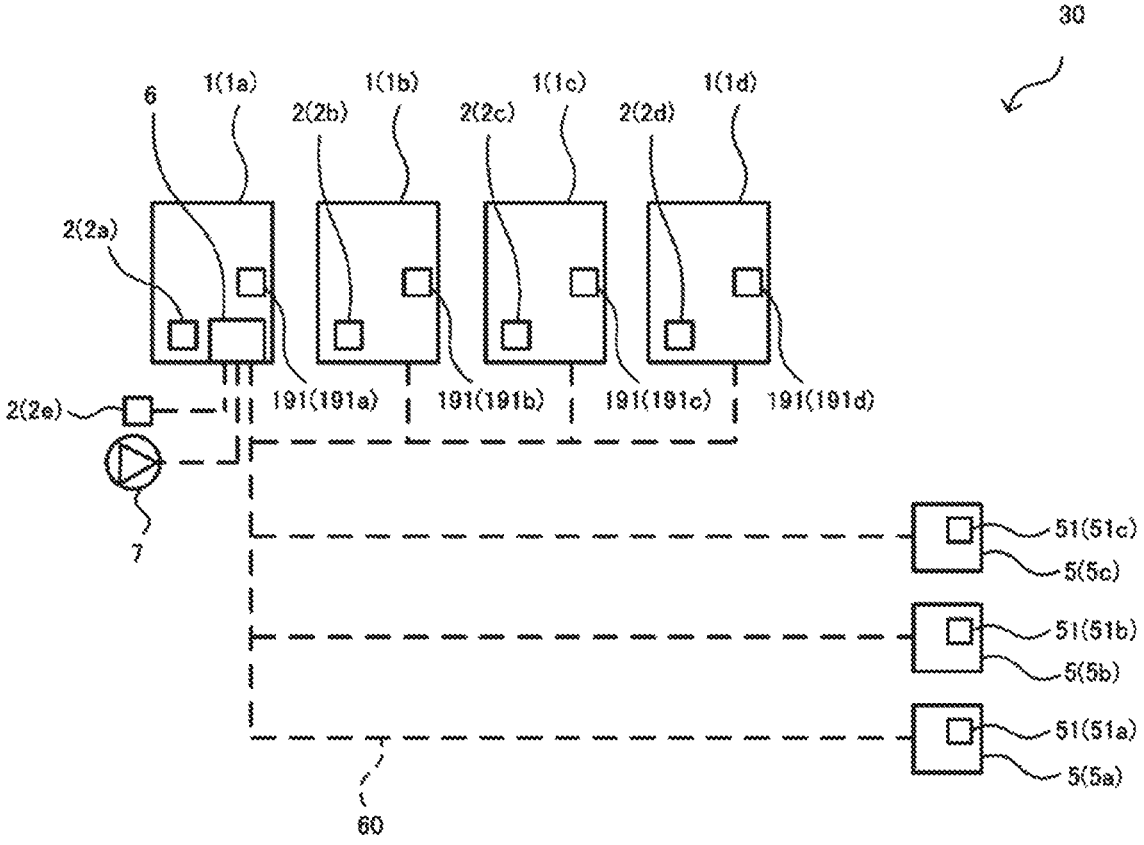
FIG. 4 is a diagram illustrating one example of a control system of the heat pump system illustrated in FIG. 1.

FIG. 4 is a diagram illustrating one example of a control system of the heat pump system illustrated in FIG. 1. As shown in FIG. 4, the plurality of heat pump devices 1, the plurality of indoor units 5, the heat medium feed device 7, and the representative temperature sensor 20 are connected by a transmission channel 60, and can communicate with one another. The transmission channel 60 uses, for example, a wired system in which the transmission channel is formed by a transmission line, but a wireless system, which uses no transmission line, may also be adopted. The first heat pump device 1*a* includes a controller 6. The controller 6 controls the entirety of the heat pump system 100. The controller 6 is, for example, a microcomputer or other devices. In the example of FIG. 4, the controller 6 is disposed inside the first heat pump device 1*a*. It is noted that the controller 6 may be disposed in any of the heat pump devices 1 or any of the indoor units 5. In addition, the controller 6 may also be disposed in a remote controller (illustration is omitted) that is disposed outside the heat pump devices 1 and the indoor units 5. In addition, a plurality of the controllers 6 may also be disposed in some of the heat pump devices 1 or the indoor units 5, and control the entirety of the heat pump system 100 in a coordinated manner.

The controller 6 controls the compressor 11, the expansion valve 14, or the heat source side fan 18 of each of the heat pump devices 1, the heat medium feed device 7, the indoor fan 53 of each of the indoor units 5, or other parts, for example, by using the temperatures detected by the heat medium temperature sensors 2, the indoor temperatures detected by the room temperature sensors 51, and a set temperature in the room. The set temperature in the room is a target temperature in the room where the heat pump system 100 conditions air. The set temperature is input from a remote controller (illustration is omitted) by the user, for example, and is stored in the controller 6.

For example, the controller 6 controls the refrigerant circuits 17 or the indoor units 5 by using the set temperature in the room, the indoor temperatures detected by the room temperature sensors 51, and the temperatures detected by the heat medium temperature sensors 2 in such a manner that the indoor temperatures detected by the room temperature sensors 51 are not deviated from the set temperature. When the heat pump system 100 is controlled in such a manner that the indoor temperatures detected by the room temperature sensors 51 are not deviated from the set temperature, a comfortability in the air-conditioned space is improved.

In addition, for example, the controller 6 determines, by using the temperature of the heat medium that flows out from one or more of the heat medium heat exchangers 13, a target temperature of the heat media that flow out from the other heat medium heat exchangers 13. When the plurality of heat pump devices 1 control the temperature of the heat medium that flows into the indoor units 5 in a coordinated manner, precision of the control of the temperature of the heat medium that flows into the indoor units 5 can be increased. In addition, when the plurality of heat pump devices 1 control the temperature of the heat medium that flows into the indoor units 5 in a coordinated manner, excess cooling or heating can be curbed. It is thus possible to reduce power consumption.

In addition, for example, the controller 6 exercises the control to cause the indoor fans 53 to stop sending air when the temperatures detected by the heat medium temperature sensors 2 are higher than the set temperature in the room and the indoor temperatures detected by the room temperature sensors 51, or when the temperatures detected by the heat medium temperature sensors 2 are lower than the set temperature in the room and the indoor temperatures detected by the room temperature sensors 51. In the aforementioned case, when the indoor fan 53 is caused to stop sending air, it is possible to prevent the indoor temperature detected by the room temperature sensor 51 from deviating from the set temperature. When the deviation of the indoor temperature detected by the room temperature sensor 51 from the set temperature is prevented, the indoor comfortability is improved.

In addition, for example, when the temperatures detected by the heat medium temperature sensors 2 are higher than the set temperature in the room and also lower than the indoor temperatures detected by the room temperature sensors 51, or when the temperatures detected by the heat medium temperature sensors 2 are lower than the set temperature in the room and higher than the indoor temperatures detected by the room temperature sensors 51, the indoor fans 53 send air. In the aforementioned case, when the indoor fan 53 sends air, the indoor temperature detected by the room temperature sensor 51 approaches the set temperature. The indoor comfortability is thus improved.

When the heat pump system 100 executes a room heating mode operation for heating in the room, the heat pump devices 1 perform the heating operation. When the heat pump device 1 performs the heating operation, as the heat source side heat exchanger 15 is used as an evaporator, frost may be formed on the heat source side heat exchanger 15 in some cases. In a case where the frost is formed on the heat source side heat exchanger 15, as the heat exchange efficiency of the heat source side heat exchanger 15 decreases, defrosting is performed to melt frost on the heat source side heat exchanger 15. When the defrosting of the heat source side heat exchanger 15 is performed, for example, the heat source side heat exchanger 15 is used as a condenser, and the heat medium heat exchanger 13 is used as the evaporator. When the heat medium heat exchanger 13 is used as the evaporator, the heat medium is cooled. When the heat medium is cooled to decrease the temperature of the heat medium that flows into the indoor units 5, the indoor comfortability may deteriorate. In view of the above, the heat pump system 100 of this embodiment exercises the following control.

FIG. 5 is a diagram illustrating one example of an operation of the heat pump system illustrated in FIG. 1. At a time t1 illustrated in FIG. 5, the heat pump system 100 performs the room heating mode operation, and for example, the first heat pump device 1*a* to the fourth heat pump device 1*d* perform the heating operation for heating the heat medium. The first heat pump device 1*a* to the fourth heat pump device 1*d* are controlled, for example, in such a manner that heat medium temperatures Tm detected by the first outflow temperature sensor 2*a* to the fourth outflow temperature sensor 2*d* equal to a target temperature Tu. The target temperature Tu is determined, for example, on the basis of the indoor temperatures detected by the room temperature sensors 51 and the set temperature in the room, and is stored in the controller 6.

At a time t2, it is detected that the heat pump system 100 approaches a timing for defrosting the first heat pump device 1*a*, and the first heat pump device 1*a* makes defrosting preparation. For example, it is detected that when a frost formation amount of the heat source side heat exchanger 15 of the first heat pump device 1*a* is higher than a first frost formation amount A, the controller 6 makes the defrosting preparation of the first heat pump device 1*a*. For example, when a detected value Th of the heat exchanger downstream temperature sensor 191 illustrated in FIG. 2 is lower than a threshold temperature Ta, the controller 6 determines that the frost formation amount of the heat source side heat exchanger 15 is higher than the first frost formation amount A.

At a time t3 illustrated in FIG. 5, the heat pump system 100 executes a heat storage mode operation. It is noted that the time t2 and the time t3 are substantially the same time. In other words, when the defrosting preparation is detected at the time t2, the heat storage mode operation is immediately executed at the time t3. In the heat storage mode operation, the heat pump system 100 increases the temperature of the heat medium as compared with the temperature at the time of the room heating mode operation. For example, at the time of the heat storage mode operation, a rotation frequency of the compressor 11 is increased as compared with a rotation frequency at the time of the room heating mode operation. In addition, for example, at the time of the heat storage mode operation, the number of heat pump devices 1 that perform the heating operation is increased as compared with the number at the time of the room heating mode operation. In the heat storage mode operation, for example, the first heat pump device 1*a* to the fourth heat pump device 1*d* are controlled in such a manner that the heat medium temperatures Tm detected by the first outflow temperature sensor 2*a* to the fourth outflow temperature sensor 2*d* equal to a target temperature Tu+α. A correction value α, for example, is previously set, and stored in the controller 6. When the heat pump system 100 performs the heat storage mode operation, the flow rate of the sending air from the indoor fans 53 is preferably decreased. This is because the temperature of the heat medium at the time of the heat storage mode operation is higher as compared with the temperature at the time of the room heating mode operation, and the temperature in the room may disadvantageously increase to be higher than the set temperature in the room.

At a time t4, it is detected that the heat pump system 100 starts defrosting of the first heat pump device 1*a*. For example, when the frost formation amount of the heat source side heat exchanger 15 of the first heat pump device 1*a* is higher than a second frost formation amount B that is higher than the first frost formation amount A, it is determined that the controller 6 starts defrosting of the first heat pump device 1*a*. For example, when the detected value Th of the heat exchanger downstream temperature sensor 191 illustrated in FIG. 2 is lower than a threshold temperature Tb that corresponds to a temperature lower than the threshold temperature Ta, the controller 6 determines that the frost formation amount of the heat source side heat exchanger 15 is higher than the second frost formation amount.

At a time t5, the heat pump system 100 executes a defrost mode operation. It is noted that the time t4 and the time t5 are substantially the same time. In other words, when the start of the defrosting is detected at the time t4, the defrost mode operation immediately is executed at the time t5. When the heat pump system 100 performs a defrosting operation of the first heat pump device 1*a*, the first heat pump device 1*a* performs the defrosting operation, and for example, the second heat pump device 1*b* to the fourth heat pump device 1*d* perform the heating operation.

The second heat pump device 1*b* to the fourth heat pump device 1*d* that do not perform defrosting are controlled, for example, in such a manner that the heat medium temperatures Tm detected by the second outflow temperature sensor 2*b* to the fourth outflow temperature sensor 2*d* equal to the target temperature Tu+α. For example, when the defrost mode operation is executed, the rotation frequency of the compressor 11 of the heat pump device 1 that does not perform the defrosting is increased as compared with the rotation frequency at the time of the room heating mode operation. In addition, for example, when the defrost mode operation is executed, the number of heat pump devices 1 that perform the heating operation is increased as compared with the number at the time of the room heating mode operation.

The controller 6 determines a target temperature Tu−β of the heat medium that flows out from the first heat pump device 1*a* that performs defrosting by using the heat medium temperatures Tm of the heat media that flow out from the second heat pump device 1*b* to the fourth heat pump device 1*d* that do not perform defrosting. For example, the target temperature Tu−β of the heat medium that flows out from the first heat pump device 1*a* that performs defrosting is determined in such a manner that an indoor unit inflow temperature Ti detected by the representative temperature sensor 20 is higher than or equal to a defrosting operation target heat medium temperature To. It is noted that the indoor unit inflow temperature Ti detected by the representative temperature sensor 20 is increased by reducing the number of heat pump devices 1 that perform defrosting or decreasing the rotation frequency of the compressor 11 of the heat pump device 1 that performs defrosting. When the temperature of the heat medium that flows into the indoor units 5 is set to be higher than or equal to the defrosting operation target heat medium temperature To, the decrease of the temperature in the room can be reduced. The indoor comfortability is thus improved.

For example, the defrosting operation target heat medium temperature To is higher than or equal to a set temperature Ts in the room or indoor temperatures Tr detected by the room temperature sensors 51. When the temperature of the heat medium that flows into the indoor units 5 is set to be higher than or equal to the set temperature Ts, the inside of the room is warmed up by the heat medium at a temperature higher than or equal to the set temperature Ts. The indoor comfortability is thus improved. When the temperature of the heat medium that flows into the indoor units 5 is set to be higher than or equal to the indoor temperatures Tr detected by the room temperature sensors 51, the indoor temperatures Tr detected by the room temperature sensors 51 do not decrease. It is thus possible to reduce the decrease of the indoor comfortability.

It is noted that the defrosting operation target heat medium temperature To is preferably higher than or equal to the indoor temperatures Tr detected by the room temperature sensors 51, but the defrosting operation target heat medium temperature To may be lower than the indoor temperatures Tr detected by the room temperature sensors 51 in some cases. For example, the aforementioned cases include a case when defrosting of the plurality of heat pump devices 1 is performed at the same time, a case when defrosting needs to be rapidly performed, or other cases. When the defrosting operation target heat medium temperature To is lower than the indoor temperatures Tr detected by the room temperature sensors 51, the indoor temperature decreases as the indoor fans 53 are operated, and the indoor comfortability decreases. In view of the above, when the defrosting operation target heat medium temperature To is lower than the indoor temperatures Tr detected by the room temperature sensors 51, the indoor fans 53 are stopped to reduce the decrease of the indoor comfortability.

The defrosting of the first heat pump device 1*a* is completed by a time t6, and the room heating mode operation is resumed at the time t6. In other words, the operation of the first heat pump device 1*a* that performs the defrosting operation is switched to a room heating operation at the time t6. It is noted that with regard to the completion of the defrosting of the first heat pump device 1*a*, for example, when the detected value Th of the heat exchanger downstream temperature sensor 191 illustrated in FIG. 2 is lower than a threshold temperature Tf, it is determined that the frost formation of the heat source side heat exchanger 15 disappears.

Figure 6:
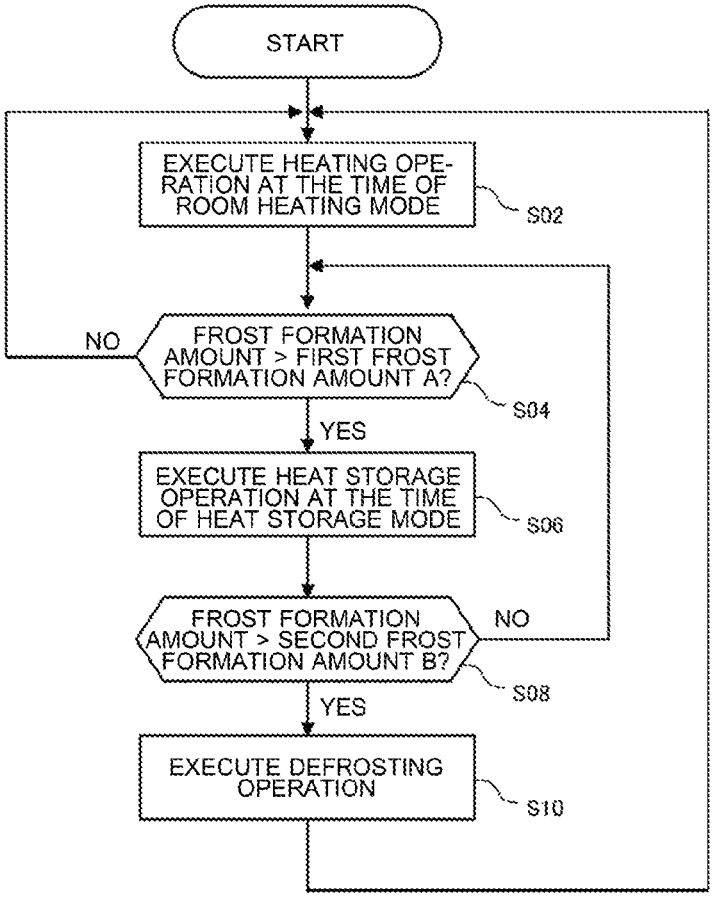
FIG. 6 is a diagram illustrating one example of an operation of the heat pump device illustrated in FIG. 1.

FIG. 6 is a diagram illustrating one example of an operation of the heat pump device shown in FIG. 1. In step S02, the heat pump device 1 executes the heating operation for heating the heat medium. In step S04, when the frost formation amount of the heat source side heat exchanger 15 is lower than or equal to the first frost formation amount, in step S02, the heating operation continues. In step S04, when the frost formation amount is higher than the first frost formation amount, in step S06, the heat pump device 1 executes a heat storage operation. In step S08, when the frost formation amount of the heat source side heat exchanger 15 is lower than or equal to the second frost formation amount, the heat pump device 1 returns to step S04. In step S08, when the frost formation amount of the heat source side heat exchanger 15 is higher than the second frost formation amount, in step S10, the heat pump device 1 executes the defrosting operation. When the defrosting operation is completed, the heat pump device 1 returns to step S02, and the heat pump device 1 resumes the heating operation.

As described above, the heat pump system 100 in the example of this embodiment executes the heat storage mode operation for increasing the temperature of the heat medium than the temperature at the time in the room heating mode operation in a period after the room heating mode operation is executed and before the defrost mode operation is executed. In the example of this embodiment, as the heat medium is warmed up in the heat storage mode operation before the defrost mode operation is executed, it is possible to reduce the decrease of the temperature of the heat medium at the time of the defrost mode operation. When the decrease of the temperature of the heat medium at the time of the defrost mode operation is reduced, as the decrease of the temperature in the room at the time of the defrost mode operation can be reduced, the indoor comfortability is improved.

The present disclosure is not limited to the aforementioned embodiment, and various modification can be made within the scope of the present disclosure. In other words, the configurations of the aforementioned embodiment may be appropriately modified, and also, at least a part of the configurations may also be substituted with other part. Furthermore, a location of a component that is not particularly limited is not limited to the location disclosed according to the embodiment, and can be a location where a function of the component can be achieved.

For example, the descriptions of the example have been provided above where the defrosting operation of the first heat pump device 1*a* is performed, but when frost is formed on the second heat pump device 1*b* to the fourth heat pump device 1*d*, the defrosting operation of the second heat pump device 1*b* to the fourth heat pump device 1*d* can be performed. In addition, the descriptions of the example have been provided above where the defrosting of the single heat pump device 1 is performed, but defrosting of two or more of the heat pump devices 1 can be performed at the same time.

In addition, for example, the descriptions of the example have been provided above where the defrosting operation of the heat pump device 1 is performed while the heat source side heat exchanger 15 is used as the condenser, and the heat medium heat exchanger 13 is used as the evaporator. However, a configuration can be adopted where the defrosting operation is performed while the heat source side heat exchanger 15 is used as the condenser, and the refrigerant does not flow into the heat medium heat exchanger 13. In addition, a configuration can be adopted where the heat pump device 1 performs defrosting by using an electric heater or other devices.

In addition, the descriptions of the example have been provided above where the frost formation amount of the heat source side heat exchanger 15 is detected, and the heat storage mode operation and the defrost mode operation are executed, but the heat pump system 100 may also execute the heat storage mode operation and the defrost mode operation as previously scheduled. For example, a configuration can be adopted where the heat pump system 100 executes the heat storage mode operation when a previously set time elapses, and the heat pump system 100 executes the defrost mode operation when a previously set time elapses. In addition, for example, a configuration can be adopted where when the frost formation of the heat source side heat exchanger 15 is detected, the heat pump system 100 executes the heat storage mode operation for a set period of time that is previously set, and the heat pump system 100 executes the defrost mode operation for a set period of time that is previously set.

REFERENCE SIGNS LIST

1 heat pump device 1*a* first heat pump device 1*b* second heat pump device 1*c* third heat pump device 1*d* fourth heat pump device 2 heat medium temperature sensor 2*a* first outflow temperature sensor 2*b* second outflow temperature sensor 2*c* third outflow temperature sensor 2*d* fourth outflow temperature sensor 3 heat medium pipe 5 indoor unit 5*a* first indoor unit 5*b* second indoor unit 5*c* third indoor unit 6 controller 7 heat medium feed device 11 compressor 12 flow path switch device 13 heat medium heat exchanger 13*a* refrigerant flow path 13*b* heat medium flow path 14 expansion valve 15 heat source side heat exchanger 16 refrigerant pipe 17 refrigerant circuit 18 heat source side fan 19 accumulator 20 representative temperature sensor 30 heat medium feed path 51 room temperature sensor 51*a* first room temperature sensor 51*b* second room temperature sensor 51*c* third room temperature sensor 52 use side heat exchanger 53 indoor fan 60 transmission channel 100 heat pump system 191 heat exchanger downstream temperature sensor

The invention claimed is:

1. A heat pump system, comprising:

a refrigerant circuit in which a compressor, a refrigerant flow path included in a heat medium heat exchanger, an expansion valve, and a heat source side heat exchanger are connected, the heat medium heat exchanger including the refrigerant flow path and a heat medium flow path;

a heat medium feed path connected to the heat medium flow path included in the heat medium heat exchanger;

an indoor unit connected to the heat medium feed path and including an indoor fan, the indoor unit being configured to condition air inside a room;

a room temperature sensor configured to detect an indoor temperature in the room;

a heat medium temperature sensor configured to detect a temperature of a heat medium that flows into the indoor unit; and a controller configured to control a flow rate of air sent from the indoor fan by using a set temperature in the room, the indoor temperature detected by the room temperature sensor, and the temperature detected by the heat medium temperature sensor in such a manner that the indoor temperature detected by the room temperature sensor is not deviated from the set temperature.

2. The heat pump system of claim 1, further comprising a plurality of the refrigerant circuits.

3. The heat pump system of claim 2, wherein the heat medium temperature sensor includes a plurality of outflow temperature sensors each configured to detect a temperature of the heat medium that flows out from a corresponding one of a plurality of the heat medium heat exchangers in the plurality of the refrigerant circuits.

4. The heat pump system of claim 3, wherein the plurality of the refrigerant circuits are mutually connected in parallel and connected to the heat medium feed path, and the heat medium temperature sensor includes a representative temperature sensor configured to detect a temperature of the heat medium that passes through all of the plurality of the heat medium heat exchangers before the heat medium flows into the indoor unit.

5. The heat pump system of claim 3, wherein the controller is configured to determine, by using a temperature of the heat medium that flows out from one or more of the plurality of the heat medium heat exchangers, a target temperature of the heat medium that flows out from the heat medium heat exchanger other than the one or more of the plurality of the heat medium heat exchangers.

6. The heat pump system of claim 2, wherein the controller is configured to execute a defrosting mode operation for defrosting one or more of the heat source side heat exchangers in the plurality of the refrigerant circuits.

7. The heat pump system of claim 6, wherein the controller is configured to increase, when the controller executes the defrosting mode operation, a rotation frequency of the compressor connected to the heat source side heat exchanger that does not perform defrosting as compared with a rotation frequency before the defrosting mode operation is performed.

8. The heat pump system of claim 6, wherein the controller is configured to execute, in a period after the heat pump system executes a room heating mode operation for performing heating in the room and before the heat pump system executes the defrosting mode operation, a heat storage mode operation for increasing a temperature of the heat medium than a temperature of the heat medium when the room heating mode operation is performed.

9. The heat pump system of claim 8, further comprising a frost formation detection sensor configured to detect frost formation of the heat source side heat exchanger, wherein the controller is configured to execute the heat storage mode operation when the controller determines that a frost formation amount of the heat source side heat exchanger is higher than a first frost formation amount by using a detection result of the frost formation detection sensor.

10. The heat pump system of claim 9, wherein the controller is configured to execute the defrosting mode operation when the controller determines that the frost formation amount of the heat source side heat exchanger is higher than a second frost formation amount, the second frost formation amount being higher than the first frost formation amount.

11. The heat pump system of claim 9, wherein the frost formation detection sensor includes a heat exchanger downstream temperature sensor configured to detect a temperature of refrigerant subjected to heat exchange in the heat source side heat exchanger.

12. The heat pump system of claim 6, wherein the controller is configured to maintain, when the controller executes the defrosting mode operation, the temperature detected by the heat medium temperature sensor to be higher than or equal to a defrosting operation target heat medium temperature.

13. The heat pump system of claim 12, wherein the defrosting operation target heat medium temperature is set to a temperature higher than or equal to the set temperature or the indoor temperature detected by the room temperature sensor.

14. The heat pump system of claim 1, wherein the indoor unit includes a use side heat exchanger in which the heat medium flows, the indoor fan is configured to send air to the use side heat exchanger, the controller is configured to stop sending of air by the indoor fan when the temperature detected by the heat medium temperature sensor is higher than the set temperature and the indoor temperature detected by the room temperature sensor, or when the temperature detected by the heat medium temperature sensor is lower than the set temperature and the indoor temperature detected by the room temperature sensor, and the controller is configured to cause the indoor fan to send air when the temperature detected by the heat medium temperature sensor is higher than the set temperature and lower than the indoor temperature detected by the room temperature sensor, or when the temperature detected by the heat medium temperature sensor is lower than the set temperature and higher than the indoor temperature detected by the room temperature sensor.

15. The heat pump system of claim 1, wherein the refrigerant circuit includes a flow path switch device configured to change a direction in which refrigerant flows to a direction in which the refrigerant flows in a heating operation in which the heat medium heat exchanger heats the heat medium and to a direction in which the refrigerant flows in a cooling operation in which the heat medium heat exchanger cools the heat medium.

16. A heat pump system, comprising:

a plurality of refrigerant circuits in each of which a compressor, a refrigerant flow path included in a heat medium heat exchanger, an expansion valve, and a heat source side heat exchanger are connected, the heat medium heat exchanger including the refrigerant flow path and a heat medium flow path;

a heat medium feed path connected to the heat medium flow path included in the heat medium heat exchanger;

an indoor unit connected to the heat medium feed path and configured to condition air inside a room;

a heat medium temperature sensor configured to detect a temperature of a heat medium that flows into the indoor unit; and a controller configured to control the plurality of refrigerant circuits or the indoor unit, the heat medium temperature sensor including a plurality of outflow temperature sensors each configured to detect a temperature of the heat medium that flows out from a corresponding one of a plurality of the heat medium heat exchangers in the plurality of refrigerant circuits, the controller being configured to determine, by using a temperature of the heat medium that flows out from one or more of the plurality of the heat medium heat exchangers, a target temperature of the heat medium that flows out from the heat medium heat exchanger other than the one or more of the plurality of the heat medium heat exchangers.

* * * * *